US008857122B2

(12) United States Patent
Wathne

(10) Patent No.: US 8,857,122 B2
(45) Date of Patent: Oct. 14, 2014

(54) SYSTEM OF TYING, CLEANING AND RE-CEMENTING MASONRY USING PORT ANCHORS

(76) Inventor: John M. Wathne, Salem, MA (US)

( * ) Notice: Subject to any disclaimer, the term of this patent is extended or adjusted under 35 U.S.C. 154(b) by 0 days.

(21) Appl. No.: 13/523,542

(22) Filed: Jun. 14, 2012

(65) Prior Publication Data

US 2012/0317920 A1 Dec. 20, 2012

Related U.S. Application Data

(60) Provisional application No. 61/496,744, filed on Jun. 14, 2011.

(51) Int. Cl.

| | |
|---|---|
| ***E04B 1/38*** | (2006.01) |
| ***E04B 1/41*** | (2006.01) |
| ***E04G 23/02*** | (2006.01) |

(52) U.S. Cl.

CPC ... *E04B 1/38* (2013.01); *E04B 1/41* (2013.01); *E04G 23/02* (2013.01); *E04G 23/0222* (2013.01)

USPC ..... 52/513; 52/379; 52/514.5; 411/82.1; 405/259.5

(58) Field of Classification Search

CPC ..... E04G 23/0207; E04B 1/41

USPC ..... 52/127.4, 379, 698, 699, 704, 708, 513, 52/514.5; 405/258.1, 259.1, 259.3, 259.5; 411/82.1, 19

See application file for complete search history.

(56) References Cited

U.S. PATENT DOCUMENTS

| | | | | | |
|---|---|---|---|---|---|
| 4,044,512 | A | * | 8/1977 | Fischer et al. | 52/127.4 |
| 4,096,672 | A | * | 6/1978 | Fischer et al. | 52/127.4 |
| 4,355,933 | A | * | 10/1982 | Fischer | 411/19 |
| 4,487,528 | A | | 12/1984 | Skogberg | |
| 4,741,141 | A | * | 5/1988 | Harke | 52/506.06 |
| 4,773,794 | A | | 9/1988 | Harke | |
| 4,836,729 | A | | 6/1989 | Bisping | |
| 4,930,284 | A | * | 6/1990 | Falco | 52/704 |
| 5,003,749 | A | * | 4/1991 | Harke | 52/703 |

(Continued)

FOREIGN PATENT DOCUMENTS

| | | |
|---|---|---|
| CA | 2048545 C | 10/2004 |
| CA | 2245121 C | 8/2006 |

OTHER PUBLICATIONS

International Search Report dated Jan. 25, 2013 for PCT/US12/42484.

Written Opinion dated Jan. 25, 2013 for PCT/US12/42484.

*Primary Examiner* — William Gilbert
*Assistant Examiner* — Alp Akbasli
(74) *Attorney, Agent, or Firm* — Burns & Levinson LLP; Jacob N. Erlich; Marlo Schepper Grolnic

(57) ABSTRACT

A port anchor system and method for anchoring and cementing adjacent and often separated leaves (layered structures) of masonry. The method and various embodiments have the capability of being used for anchoring, cleaning and flushing of old mortar, and injecting grout into internal masonry voids, thereby tying and re-cementing or cementing the masonry mass back together. Various embodiments of anchor systems are provided for performing the various methods, more particularly, some of the embodiments describe port anchors which are used to clean and flush the old mortar and then grout fill the void between adjacent masonry leaves while other embodiments are used to grout fill the void.

26 Claims, 7 Drawing Sheets

(56) References Cited

U.S. PATENT DOCUMENTS

| | | | | |
|---|---|---|---|---|
| 5,216,857 | A | 6/1993 | Harke | |
| 5,243,805 | A * | 9/1993 | Fricker | 52/698 |
| 6,189,281 | B1 | 2/2001 | Sobek | |
| 6,402,427 | B1 | 6/2002 | James | |
| 6,499,268 | B2 | 12/2002 | James | |
| 6,513,300 | B1 | 2/2003 | James | |
| 6,543,977 | B2 * | 4/2003 | Sander et al. | 411/82.1 |
| 6,681,545 | B1 | 1/2004 | James | |
| 7,404,274 | B2 | 7/2008 | Hayes | |
| 2008/0148664 | A1 | 6/2008 | Hayes | |
| 2012/0291394 | A1 * | 11/2012 | Tooman | 52/699 |

* cited by examiner

SYSTEM OF TYING, CLEANING AND RE-CEMENTING MASONRY USING PORT ANCHORS

CROSS REFERENCE TO RELATED APPLICATION

This application claims priority of U.S. Provisional Application Ser. No. 61/496,744 entitled System of Tying, Cleaning and Re-cementing Masonry Using Port Anchors filed Jun. 14, 2011 and which is incorporated herein in its entirety.

BACKGROUND OF THE INVENTION

Presently the market has a limited number of marginally effective or economical ways to address the problem of delaminating unintentionally voided masonry piers and/or walls usually associated with separation between leaves (leafs or layers) of masonry. A restorer has the choice of dismantling and reconstructing the affected masonry at great expense and occasional danger, or using an array of existing, externally applied products and systems to try to knit the masonry back together but never fully restoring its structural integrity. Some of the prior options which attempt to but do not meet current needs or accomplish all of the functions of tying and cementing voided masonry back together are as follow:

a) Injection Grouting Systems into Voids: These systems require numerous drill holes to inject grout (to attempt to "glue" the masonry together) and sometimes separate drill holes to install anchors, if needed for additional tying of the masonry. Such systems can only partially rely on the adhesiveness of the grout to hold the masonry together, and must therefore rely on the presence of ties, and have little or no mechanism for scoping and cleaning the voids that must be filled, thereby establishing a proper, cementing bond. Thus, these systems can lead to major problems in the stabilization of masonry and require numerous drill holes which can increase the potential danger of the repair operation. Some grout injection systems do not rely on ties, however, these employ high strength resin or cement based grout formulations that are not physically compatible with the parent masonry. Also, these systems cannot be used at below 32 degrees F. temperature as the grout will not cure properly and could freeze.

b) Epoxy-Based (Adhesive) Anchor Systems: These systems involve the insertion of tubular screens into holes that are drilled through the voided masonry, partial filling of the screens with epoxy, and then insertion of metal rods. These provide limited reliability and are not effective in spanning over large voids as not enough containment pressure is developed within the screen to uniformly cover all contact surfaces before the adhesive oozes out of the screen. Also, these systems do not attempt to actually fill the voids (in order to cement the leaves back together), and therefore have very limited shear capacity across wider voids. These systems are not generally suitable for cold temperature installations where the curing of the adhesive is slowed or halted.

c) Mechanical Wedge (Mechanical) Anchor Based Systems: These systems transfer no shear loads and make not attempt to fill the voids between leaves of masonry, rather, they simply keep the voids from widening or narrowing.

d) Dry-Set Helical (Mechanical) Anchor Systems: These systems make no attempt to fill the voids and must be vibrated and driven into place, potentially damaging and loosening delicate masonry wall systems during use.

e) Grouted Sock (Adhesion) Anchor Systems: These systems have only a moderate amount of shear capacity and contain the grout so that it does not flow into the voids. These systems will also not work in temperatures of below 32 degrees F. as the grout will not cure.

BRIEF SUMMARY OF THE INVENTION

The present system and method of anchoring and cementing adjacent and often separated leaves (layered structures) of masonry and has the capability of being used for anchoring, cleaning and flushing of old mortar, and injecting grout into internal masonry voids, thereby tying and re-cementing or cementing the masonry mass back together. Various embodiments of anchor systems are provided for performing the various methods, more particularly, some of the embodiments describe port anchors which are used to clean and flush the old mortar and then grout fill the void between adjacent masonry leaves while other embodiments are used to grout fill the void. The disclosed methods apply these various anchor systems to tie adjacent masonry leaves together as well as clean, flush and fill the void between the leaves. These embodiments negate the need for expensive and sometimes dangerous reconstruction of the masonry while providing a much better and safer result than the other old building masonry restoration systems that are currently used. Other advantages of the embodiments are that supplemental, temporary bracing can be directly attached to the outer ends of the anchors to resist grouting pressures that would tend to separate the leaves, and heating wands can be temporarily inserted into the open shanks of the anchors so that they can be installed under temperatures that are lower than 40 degrees.

More specifically, the anchor system is used to repair a masonry structure with a pair of leaves having a void between the leaves. The anchor system is made up of a hollow tube extending in the longitudinal direction, the hollow tube having at least one opening therein between the interior of the hollow tube and the void, an adhesion anchor adjacent one end of the hollow tube, the adhesion anchor being made of a flexible material configured to have a hollow interior for receiving a flowable substance therein, an anchor adjacent another end of the hollow tube, a feeder tube associated with the adhesion anchor for feeding the flowable substance into the hollow interior of the adhesion anchor in order to expand said adhesion anchor; and an opening associated with an end of the hollow tube for permitting a flowable substance to flow into the hollow tube and out of the at least one opening in the hollow tube into the void between adjacent leaves of the structure. Wherein the flowable substance for the interior of the adhesion anchor may be a hardening adhesive substance.

In a further embodiment, the hollow tube is replaced with at least one rod which extends in the longitudinal direction, an adhesion anchor adjacent one end of the at least one rod, the adhesion anchor being made of a flexible material configured to have a hollow interior for receiving a flowable substance therein, an anchor adjacent another end of the at least one rod, a feeder tube associated with the adhesion anchor for feeding a flowable substance into the hollow interior of the adhesion anchor in order to expand the adhesion anchor, and an open space adjacent the at least one rod and within the void for permitting a flowable substance to flow adjacent the at least one rod into the void between adjacent leaves of the masonry structure.

Further, the method of repairing a masonry structure having first and second leaves having a void therebetween includes the steps of: providing at least one hole through the first leaf and continuing through at least a portion of the second leaf; inserting an anchor system into the at least one hole in the first leaf and into the hole in the second leaf such that a portion of the anchoring system is located within the void between leaves; expanding a portion of the anchor system within the opening in the second leaf to secure the anchor system in place; securing another portion of the anchor system within the opening in the first leaf; providing pressurized water or air through an opening within the anchor system located within the void of the masonry structure in order to clean out old grout or cement located within the void between leaves; and providing a flowable substance through the opening within the anchor system located in the void between the first and second leaf in order to permit the flowable substance to flow into the void between leaves to secure the leaves of the masonry structure together and wherein the flowable substance may be a non-shrinkable hardening substance.

For a better understanding of the present invention, together with other and further objects thereof, reference is made to the accompanying drawings and detailed description, and the scope of the invention will be set forth in the appended claims.

DETAILED DESCRIPTION OF THE INVENTION

Figure 1:
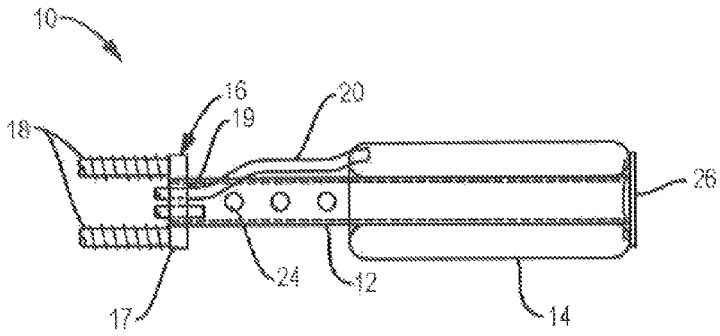
FIG. 1 is a schematic side view of one embodiment of a port anchor system with one adhesion-based anchor end and one mechanical or threaded connection end which can be used for attachment of external bearing plates and bracing, used for grouting voids and not necessarily cleaning them.

The various embodiments of this invention provide for a variety of grouted port anchor systems, that is, anchor systems utilizing an opening therethrough as shown in FIGS. 1-8 and FIGS. 11-16. As a brief summary, these embodiments utilize a variety of, but not limited to, specifically designed armature rods, preferably made of, but not limited to, stainless steel with a variety of mechanical (nutted) bearing anchorages and/or adhesion (meaning using outward pressure or chemical bond) anchors at opposite ends to hold multiple, delaminated leaves of masonry or masonry structures together. Concurrently, the voids between the leaves of masonry are, preferably, sequentially jetted and flushed clean and scoped, and then grout (or mortar) is injected through the port anchor systems (see FIGS. 9A and 10) into the voids to form short overlapping columns to span the voids, or in some cases to span and completely fill the voids, after sufficient pre-dampening of the void.

Further, for clarity of understanding of this invention, like numerals will be used throughout the specification to represent substantially the same elements or components. Further components that function substantially in the same way may be interchangeable between embodiments and therefore may not necessarily have reference numerals associated therewith in all figures.

As is shown in FIGS. 1-8 there are shown several embodiments of anchor systems which, with the present system and method, are capable of using several types of flowable substance or material such as, but not limited to grout or mortar: void filling grout and adhesion anchor filling grout (where used). The void filling grout or cement is of a non-shrinking variety of flowable material that may be formulated to best suit the application. The adhesion anchor filling grout is of a conventional type, not limited to, but may be the type provided by Cintec International, LTD under the brand name "Presstec".

Jet-cleaning of the void is accomplished by, preferably, but not limited to, the use of high pressure, low volume water jet. Flushing of the void is accomplished by, preferably, but not limited to, the use of low pressure high volume water spray. In both cases, compressed air may be combined therewith. Pre-dampening of the void may be accomplished by maintaining residual dampness after cleaning, fine misting with water, or injection of steam.

More specifically, FIG. 1 illustrates an embodiment of an anchor system or port anchor system 10 in which a "shank" or tube 12 which is hollow and may be of a variety of shapes and configurations, such as, but not limited to square or round in shape, and made preferably, but not limited to, stainless steel. An adhesion anchor 14, made preferably of, but not limited to, a sock-like element or flexible housing being hollow in the interior thereof and is made of a flexible material such as, but not limited to fabric for utilization with semi-contained cement based grout as shown. It should be noted that adhesion of anchor may also be achieved by a semi-contained resin based chemical system or a friction based system achieved through wedge action (not shown) affixed at one end of hollow tube 12. A threaded mechanical type anchor end 16 has, but is not limited to, a face washer 17 with holes, that may be welded to an end and may be tapped for removable threaded rods or bolts 18.

Referring to FIGS. 1, 3, 5 and 6, port anchor systems 10, 50, 90 and 110 have rods or bolts which are screwed into threaded holes in the face washer in order to create mechanical connections by securing stay-in-place face plates or temporary face plate, or both.

Port anchor systems 10 and 50 are used with large stay-in-place plates against the front leaf of a structure where there is no need to architecturally conceal the front leaf connections. Port anchor systems 90 and 110 are used with smaller stay-in-place plates in combination with adhesion anchors at the front leaf where there is insufficient leaf thickness or strength for all of the required load to be resisted by the adhesion anchors alone.

Port anchor systems 10, 50, 90 and 110 may also secure temporary plates that are used to clamp temporary bracing against the front leaf where the front leaf is not strong enough to span between anchors to resist the fluid pressures of the void filling grout without the additional bracing, which can be removed after the grout has become sufficiently stiff that the fluid pressures have dissipated.

Referring back to FIG. 1, hole 19 is located substantially in the center of the adhesion anchor for injecting the void filling grout. A feeder pipe or tube 20, preferably, but not limited to plastic or thin stainless steel, may run adjacent rod 12 or located with the hollow interior of rod 12. The pipe 20, used with adhesion anchors that employ resin or grout based systems but not with adhesion anchors that use friction. Pipe 20 interconnects with the adhesion anchor and is used to fill the adhesion anchor with grout or the like where used.

Figure 9A:
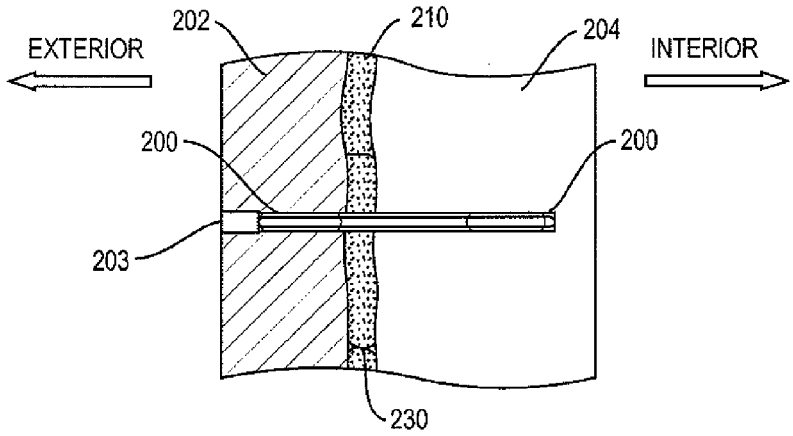
FIG. 9A is a side cross sectional view of one type of installation of a port anchor system applied from the exterior.
Figure 9B:
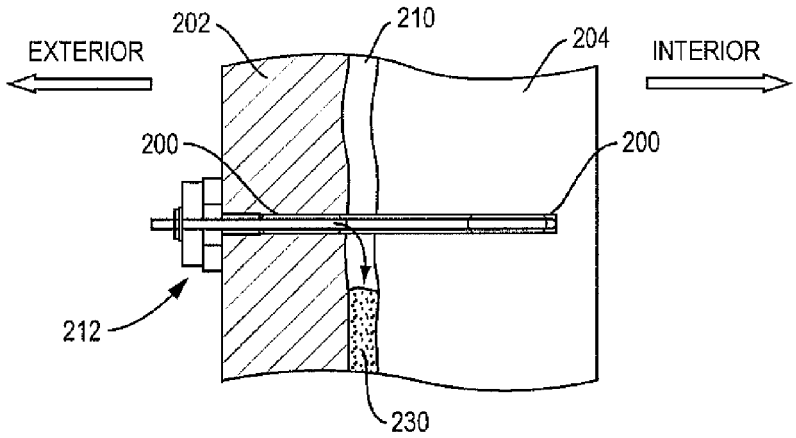
FIG. 9B is a side cross sectional view of the installation as shown in FIG. 9A in which the removable face plate or jig is shown.
Figure 10:
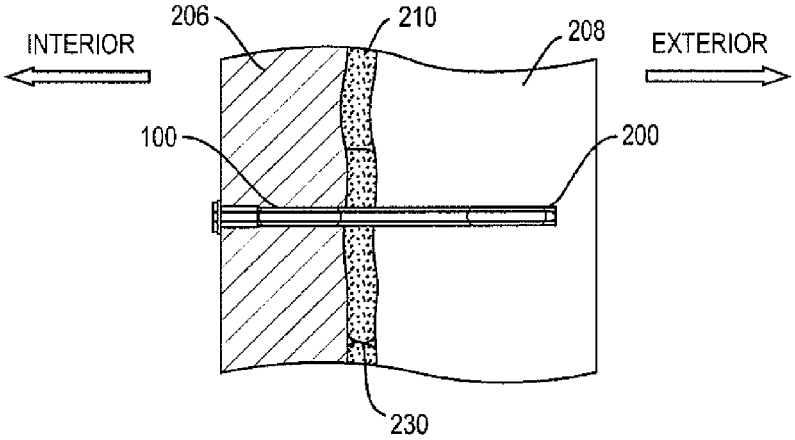
FIG. 10 is a side cross sectional view of one type of installation of a port anchor system applied from the interior.

A series of diffuser holes 24 may be located in the hollow tube 12 and are used for providing pressurized water of the like through the hollow interior of rod 12 to flush and clean old mortar or debris from voids located between separated leaves of masonry as shown in FIGS. 9A and 10 and FIG. 9B which shows the use of the removable supportive face plate or jig, and for injection of grout into the voids. At one end of hollow tube 12 face washer 17 may be made of, but not limited to, stainless steel and at the other end of hollow tube 12 an end washer type member 26 is secured by, preferably, but not limited to, welding after the placement of adhesion anchor 14. Anchor system 10 may be used for flushing and grout filling the voids, as well as securing temporary bracing or surface plating via the threaded rods or bolts 18.

Figure 2:
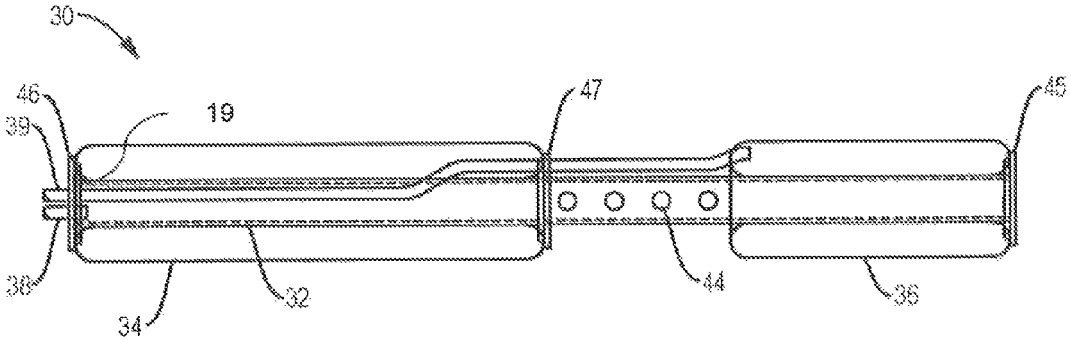
FIG. 2 is a schematic side view of another embodiment of a port anchor system with a pair of adhesion anchors, each at opposite ends of the anchor system, used for grouting voids and not necessarily cleaning them.

Reference is now made to FIG. 2 which illustrates a further embodiment of a port anchor system 30 in which an elongated hollow "shank" or tube 32, made, preferably, but not limited to, stainless steel, and has adhesion anchors 34 and 36 affixed at opposite ends of hollow tube 32. A pair of feeder pipes or tubes 38 and 39, preferably, but not limited to, plastic or thin stainless steel, may run through the hollow tube 32 and interconnect with adhesion anchors 34 and 36, respectively, in order to fill the adhesion anchors 34 and 36 with grout or the like where used.

A series of diffuser holes 44 may be located in the hollow tube 32. Each end of the port anchor system 30 is capped by washer type members 45 and 46 secured preferably to hollow tube 32 by, but not limited to, welding. There is also and intermediate washer 47 at the inner end of adhesion anchor 34, which encircles hollow tube 12. Port anchor system 30 may be used for flushing and grout filling the voids.

Figure 3:
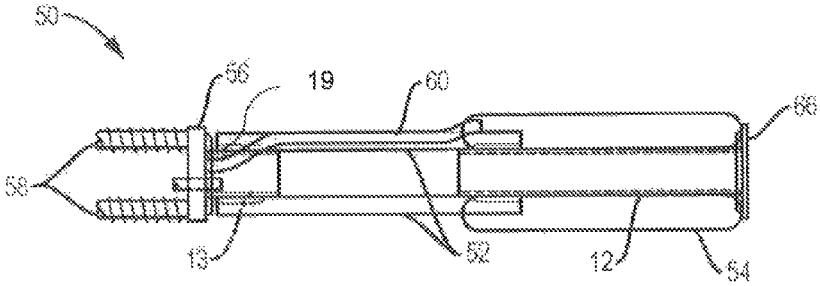
FIG. 3 is a schematic side view of still another embodiment of a port anchor system with an open shank and one adhesion anchor end and one mechanical or threaded connection end, used for cleaning voids and grouting them and attachment of external bearing plates and bracing.

Reference is now made to FIG. 3 which illustrates an embodiment of a port anchor system or anchor system 50 in which the elongated hollow tube 12 of the type shown in FIG. 1 is foreshortened and may take the form of a pair of spacer rods 52, made preferably of but not limited to stainless steel creating an open shank for part of its length. The rods 52 are placed on opposite faces of the hollow tube 12 in which adhesion anchor 54 is located at one end thereof and a threaded mechanical type anchor end which has a welded face washer 56 with holes which may be tapped for removable threaded rods or bolts 58 associated therewith. A port hole 19 located substantially in the center is used for injecting the void filling grout. The face washer or face plate is connected to rods 52 via a short length of hollow tube 13. A feeder pipe 60, preferably, but not limited to plastic or thin stainless steel, may run within adjacent rods 52 and interconnect with adhesion anchor 54 in order to be used to fill the adhesion anchor with grout or the like.

The face washer 56 at one end of rods 52 may be made of, but not limited to, stainless steel. At the other end of rods 52 a washer type member 66 is secured by, preferably, but not limited to, welding to hollow tube 12. Port anchor system 50 with the open shank space between rods 52 may be used for cleaning, flushing and grout filling the voids, as well as securing temporary bracing or surface plating via the threaded rods or bolts 58.

Figure 4:
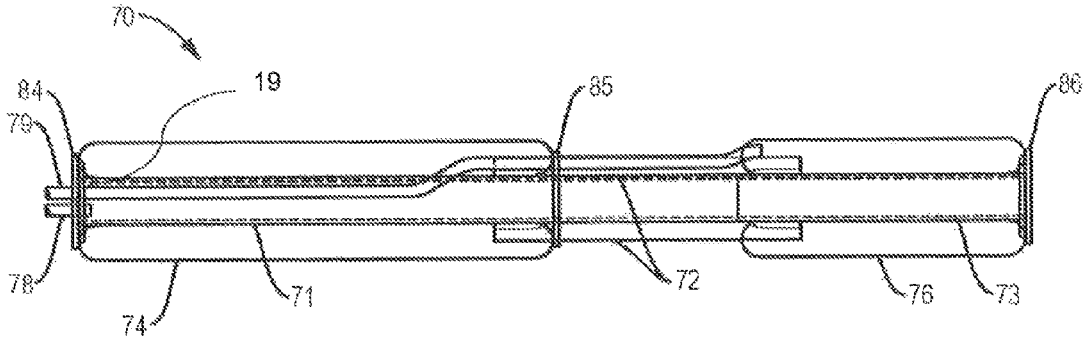
FIG. 4 is a schematic side view of a further embodiment of a port anchor system with an open shank and a pair of adhesion anchors, each at opposite ends, used for connection of masonry leaves and used for cleaning voids and grouting them.

Reference is now made to FIG. 4 (also shown schematically, pictorially in FIG. 7) which illustrates a further embodiment of a port anchor or anchor system 70 in which spacer rods 72 are utilized and made, preferably, but not limited to stainless steel. A pair of adhesion anchors 74 and 76 surround hollow tubes 71 and 73, respectively, which are located at opposite ends of spacer rods 72. Feeder pipes 78 and 79 (where used), preferably made of, but not limited to, plastic or thin stainless steel, may run within the spacer rods 72 and interconnect with adhesion anchors 74 and 76, respectively, in order to fill the adhesion anchors 74 and 76 with grout or the like.

Each end of the anchor system 70 is capped by face and end washer members 84 and 86, respectively, secured preferably by, but not limited to, welding to opposite ends of hollow tubes 71 and 73. There is also an intermediate washer, 85, fastened to the opposite end of hollow tube 71 from face washer 84. Anchor system 70 may be used for cleaning, flushing and grout filling the voids.

Figure 5:
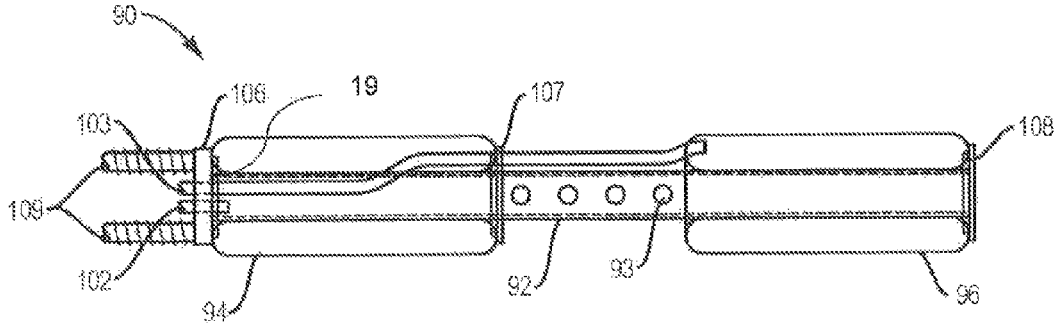
FIG. 5 is a schematic side view of still a further embodiment of a port anchor system with a pair of adhesion anchors, each at opposite ends as well as a mechanical or threaded connection at one end, used for grouting voids and not necessarily cleaning them and attachment of external bearing plates and bracing.

Reference is now made to FIG. 5 (also shown schematically, pictorially in FIG. 8) which illustrates a further embodiment of a port anchor or anchor system 90 in which the hollow tube 92 is affixed to adhesion anchors 94 and 96 located at opposite ends of hollow tube 92, and perforated with diffuser holes 93. The hollow tube 92 may be made, preferably, but not limited to, stainless steel. A pair of adhesion anchors 94 and 96 are located at opposite ends of rod 92. Feeder pipes 102 and 103 (where used) made of, preferably, but not limited to, plastic or thin stainless steel, interconnect with adhesion anchors 94 and 96, respectively in a similar manner as in the embodiments shown in FIGS. 2 and 4. The feeder pipes 102 and 103 are used to fill the adhesion anchors 94 and 96, respectively, with grout or the like.

Each end of the anchor system 90 adjacent adhesion anchors 94 and 96 is capped by face and end washer type members 106 and 108, respectively, secured preferably by, but not limited to, welding to ends of rod 92. Face washer 106 has holes therein which may be tapped for insertion therein of removable threaded rods or bolts 109. A port hole located substantially in the center for injecting the void filling grout. There is also an intermediate washer, 107, which surrounds hollow tube 92 at the end of adhesion anchor 94. Anchor 90 may be used for flushing and grout filling voids, as well as securing temporary bracing or surface plating via the threaded rods 109.

Figure 6:
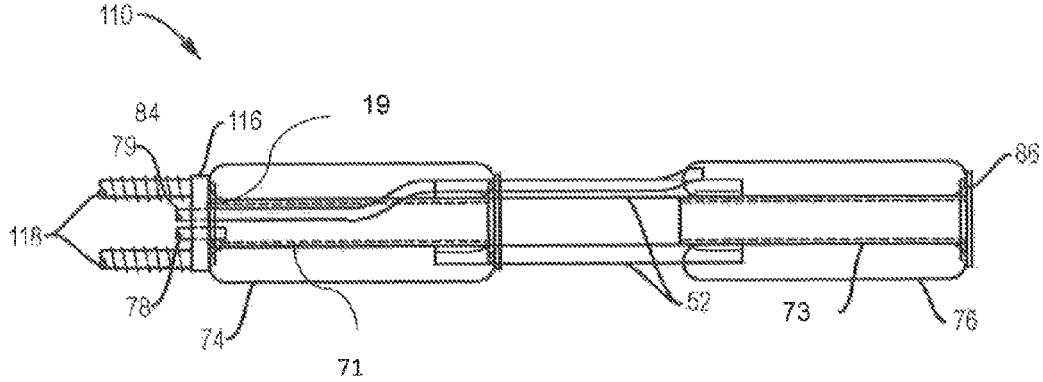
FIG. 6 is a schematic side view of another embodiment of a port anchor system with an open shank and a pair of adhesion anchors, each at opposite ends and one mechanical or threaded connection at one of the ends, used for cleaning voids and grouting them and attachment of external bearing plates and bracing.
Figure 7:
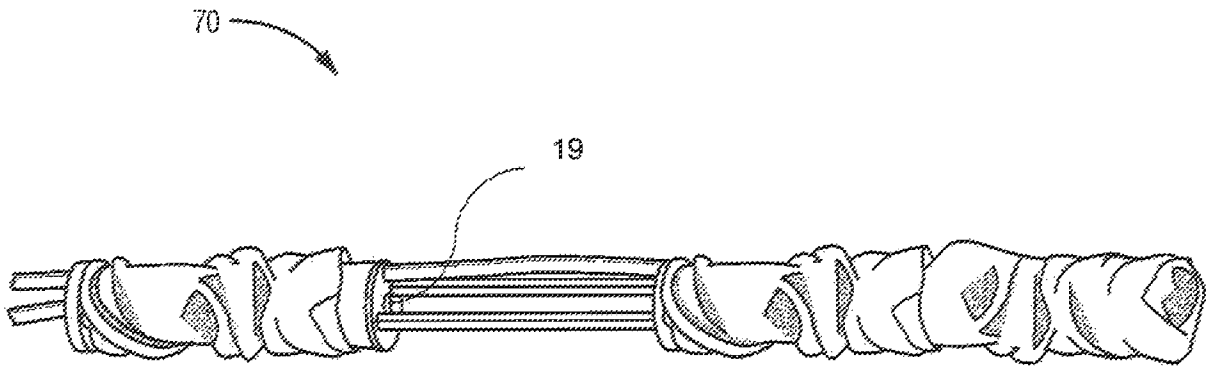
FIG. 7 is a schematic, pictorial view of the embodiment of the port anchor system shown in FIG. 4.
Figure 8:
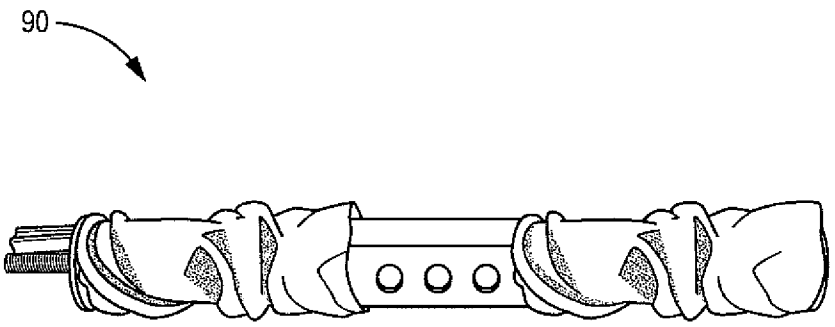
FIG. 8 is a schematic, pictorial view of the embodiment of the port anchor system shown in FIG. 5.

The anchor system 110 shown in FIG. 6 is similar to the anchor system shown in FIG. 4 except it also incorporates therewith a welded face washer or plate 116 with holes which may be tapped for removable threaded rods or bolts 118 associated therewith. A port hole 19 is located substantially in the center for injecting the void filling grout, and can additionally achieve a bearing end connection.

Throughout the embodiments the port hole 19 is located in the center of the face washer or face plate, however, it should be realized the port hole 19 may be located slightly off center for specific installations. As shown in FIG. 3, for example, but not limited to that figure, face washer or face plate 56 is connected to shank rods 52 via a short length of hollow tube 13.

The embodiment of FIG. 5 can be used for flushing and grout filling the void, as well as securing temporary bracing or surface plating via the threaded rods 109, while the embodiment of FIG. 6 can be used for cleaning, flushing and grout filling the void, as well as securing temporary bracing or surface plating via the threaded rods 118.

It should be noted that all of the port anchors or anchor systems are also used to secure the leaves or adjacent masonry wall structures in place during the cleaning, flushing and filling procedures.

FIG. 9A illustrates an exterior wall leaf 202 using a wall plug 203 or "biscuit" to cover the drilled opening to enable an anchor system to be installed from the exterior between the exterior wall leaf 202 and the separated interior wall leaf 204 without being noticeably visible from the exterior.

FIG. 10, on the other hand, illustrates an interior wall leaf 206 exposing the bearing end connection of an anchor system installed from the interior. The exterior wall leaf in this case is 208. Both FIGS. 9A and 9B and 10 show the void 210 between the wall leaves filled with old grout which is to be removed and later replaced with new grout by the system and method of this invention.

Further expanding on the system and method of this invention, the components of the various embodiments of the anchor systems are preferably made of stainless steel, but are not limited thereto, such as the use of plastic for the feeder tubes or pipes. Grout, if used for filling the adhesion anchors is preferably a cement type, high strength non-shrink grout. Grout for void filling is of a type which has chemical and functional compatibility with the existing masonry construction and is formulated to best suit existing conditions. Although the specific type of materials may vary accordingly based on the type of masonry and within the concept of this invention, constituent materials may include but are not limited to the following:

Pozzolanic or Natural Hydraulic Lime—which has many of the breathability and strength compatibility properties of the regular Lime with which many of the historic structures that must be repaired were built, but cures much more rapidly and contains less free lime in a cured state and therefore has less chance of bleeding.

Portland or Natural Cement—which improves strength, rate of cure and freeze-thaw resistance.

Non corrosive additives which improve workability and limit curing shrinkage.

Fine sand, which reduces shrinkage, material cost and embodied energy.

Water—which is the common mixing medium of all formulations.

Any other mortar or grout materials allowed under ASTM C1713, which is the Standard Specification for Mortars for the Repair of Historic Masonry, and pertains to the void filling grout formulations used in this invention and which behave like mortar in their cured state.

Mode of Operation

For an understanding of the mode of operation, the invention utilizes a number of different embodiments of the various embodiments of anchor systems described above which are used not only for anchoring or securing adjacent (leaves) of masonry together but also spanning the voids 210 (see FIGS. 9A *and* 9B and 10) between the leaves which need to be cleaned, flushed and filled. The various anchor systems are designed to enable cleaning, flushing and filling of the voids 210.

In order to repair existing leaves of masonry as shown in FIGS. 9A and 9B and 10, the method relies upon the use of the anchor systems 10, 30, 50, 70, 90 and/or 110, depending upon the existing conditions and geometry of the masonry. The anchor systems effectively, quickly and economically can use the following procedures to tie, clean, flush and fill voids between leaves of masonry so that wall leaves do not need to be taken down in order to be repaired.

Referring to FIGS. 9A and 9B and 10, a series of core holes 200 are drilled in a masonry façade, for example, shown in FIG. 9A as from an exterior wall leaf 202 and in FIG. 10 from an interior wall leaf 206. These holes 200 may penetrate through cracks and voids in the masonry. Thereafter various types of embodiments of port anchor systems as shown in FIGS. 1-6 and FIGS. 11-16 may be used. For example, anchor systems 30, 70 and 110 could be used in installations where it is difficult to conceal a bearing (face washer-bolted) type end connection, requiring a slender profile that would fit within the core hole, whereas anchor systems 10, 50 and 90 could be used where bearing (face washer-bolted) type end connections that would typically include an enlarged bearing plate, could be used at concealed interior installations and where the bearing plate could be buried under brick.

a. The embodiment shown in FIG. 1 of port anchor system 10 has a perforated hollow tube shank 12, one adhesion anchor 14 and one tapped and threaded face washer 16 to receive threaded rods or bolts for creation of a mechanical bearing type connection. This port anchor system 10 not only secures the wall leaves together by selectively applying the adhesion anchor 14 to secure the inner end of the anchor and securing the bearing end connection with rods 18 against a plate or frame (not shown) set against the masonry. Anchor system 10 is used for flushing, re-dampening (which is recommended before grouting to avoid premature drying of the grout) and then grouting or cementing the void 210. The grouting or cementing takes place by injecting the grout or cement through the hollow tube 12 such that the grout or cement flows into the void through diffuser holes 24.

b. The embodiment shown in FIG. 2 of port anchor system 30 has a perforated hollow tube shank, two adhesion anchors 34 and 36, one at each end for securing the wall leaves in place and flushing the void and re-dampening with water mist or steam as well as grouting or cementing the void through diffuser holes 44 after injecting into hollow rod 32. It is not necessarily used for cleaning the cavity.

c. The embodiment shown in FIG. 3 of port anchor system 50 has an open shank, one adhesion anchor 54 and one tapped and threaded face washer 56 to receive threaded rods or bolts for creation of a mechanical bearing type connection for both securing the wall leaves in place as well as cleaning and flushing old mortar and debris from void 210 as well as replacing the old mortar by grouting or cementing the wall structures together. Low volume high pressure water is jetted through the open shank spaces between rods into the void 210 using a water jet (not shown) to break up the old mortar and debris, and then a higher volume of low pressure water is used to clean and flush the old grout and debris out of the wall to clean it. After cleaning, the resulting void is then re-dampened with fine water spray mist or steam, and then filled with new void filling grout to cement the wall leaves back together.

d. The embodiment shown in FIG. 4 of port anchor system 70 has an open shank, two adhesion anchors 74 and 76 for securing the wall leaves in place, cleaning and flushing the voids as well as later re-dampening with fine water spray mist or steam, and then grouting them in a fashion similar to port anchor system 50, described above.

e. The embodiment shown in FIG. 5 of port anchor system 90 has two adhesion anchors 94 and 96, a perforated pipe shank, and one nutted bearing connection with nut 100. The use of diffuser holes 102 allow for the re-dampening and grouting or cementing of void 210 but it is not necessarily used for cleaning or flushing the old grout.

f. The embodiment shown in FIG. 6 of anchor system 110 has an open shank, two adhesion anchors and one mechanical or bearing connection for cleaning and flushing the void 210 as well as re-dampening and then grouting the void and cementing the wall leaves together.

More specifically, all of the port anchor systems use adhesion anchors at their inner ends and at their outer ends use an adhesion anchor (port anchor systems 30 and 70), a mechanical bearing connection (port anchor systems 10 and 50), or both in combination (port anchor systems 90 and 110) in order to hold the separated wall leaves together in a fixed position. Half of the port anchor systems (port anchor systems 50, 70 and 110) have open shanks that allow for cleaning, flushing and grouting of voids and half of the port anchor systems (port anchor systems 10, 30 and 90) have perforated pipe shanks that only allow for flushing and grouting of voids.

Adhesion anchors are always used at the far ends of the port anchor systems, which are concealed within the far ends of holes that are drilled just short of the opposite face of the far wall leaf, and are effective in transferring both horizontal tension and compression loads. Adhesion anchors or bearing plate (threaded rod or bolted) type connections are used at the near leaves, for reasons described above. While adhesion anchors can transfer both horizontal tension and compression forces, bearing connections can only transfer tension forces. In sock type adhesion anchor applications, shown, after the socks have been filled with grout to secure the anchors in place with holes, the feed pipes or tubes can be cut or removed by pulling them from the releasable or breakaway fittings, as in the embodiments of FIGS. 11-16 described below.

Following drilling of all holes 200 and installation of at least half of the port anchors systems into the drilled holes, the void 210 can be cleaned of old mortar and debris by high pressure jetting and then low pressure flushing water into the void through remaining open holes and open shank port anchors (30, 70 and 110), with old mortar and debris being removed through the remaining open holes. As shown in FIG. 9B, removable face plate or jig is used to add to the stability of the leaves during pressurized flushing and later filling of the void.

More specifically, cleaning is performed by a repeated and incremental combination of water jetting and vacuuming or draining out of old mortar and debris from between the masonry leaves. A row of open holes should remain at or near the bottom of the void to facilitate removal of the old mortar and debris along with the infused water that trickles down from above. Jetting and flushing shall be performed as part of this method using the following steps individually or in combination:

a. Low volume, high velocity, high pressure water and/or air with an oscillating or multi-directional head (not shown) for cutting into softened, decomposed masonry material within the void.

b. High volume, low pressure water for flushing out voids and spoil.

Installation of the remaining port anchor systems then take place though the remaining core holes, and may employ open shank port anchor systems (30, 70 or 110) or perforated pipe shank port anchor systems (10, 50 or 90).

Next the pre-dampening and new void filling grouting takes place, starting at the bottom and working upward through masonry structure as grout advances upward through the void. Grouting takes place in any or all of the following ways:

i. High velocity, low volume jetting of a low viscosity (fine) grout to churn up and intermix with the damp mix of old mortar and debris that remains at the bottom of the void and did not flow out of the bottom row of holes. This can also be performed as an early step in the sequence, before all of the upper holes have been drilled and before the void has been cleaned in order to provide a water-resistant plug at the bottom of void to reduce the amount of water that seeps further downward into the masonry.

ii. Low pressure, controlled volume gravity feeding or injection of low viscosity (fine) grout for best filling narrow or irregular voids that may contain stones or elements that cannot be removed by jetting and flushing.

iii. Low pressure, moderate volume gravity feeding or injection of higher viscosity (medium) grout for creating overlapping "columns" of grout that span between separated leaf surfaces within well defined voids.

Grout shall be formulated from any material that meets the requirements of ASTM C1713, but modified as needed within the limits of C1713 to work as a grout. It shall contain a shrinkage compensator and as well as other non corrosive additives, and shall be chemically and physically compatible with the existing construction, non-bleeding, and of a consistency that lends itself to the installation.

Patching of holes are then done on the exterior surfaces of the masonry to conceal the core holes made during the initial phase of the process.

i. At stone construction this shall be done by fitting biscuits trimmed from the drilling cores into the holes and adhering them with color and fleck matching repair mortar.

ii. At brick construction this shall involve installing full-face trimmed slabs cut from individual bricks (termed "soaps") over the installation holes and setting them with a mortar that matches the existing in-situ mortar.

Surface cleaning of the masonry surfaces take place following completion of the removal of old grout and installation of new grout. In addition, rear adhesion anchors should not extend into the void more than approximately one inch or a total of one quarter the void's width.

In summary, after the holes are drilled in various locations in the pair of leaves so as to install an anchor system in each of the holes in the pair of leaves as shown schematically in FIGS. 9A and 10. After the adhesive anchor(s) are filled so they expand and secure the leaves, the feeder tubes may be cut or pulled from the holes. The grout which fills and expands the sock-like elements or housings is cured for at least seven days, although the number of days may vary according to conditions. Thereafter, bracing jigs are secured to the extending threaded rods as needed and as shown in FIG. 9B in order to brace the masonry (leaves) against any water pressure when cleaning the old grout and later the grout used to secure the leaves together. It should be further noted that heating rods can also be placed in the opening through which the grout is pumped in order to heat the area. The heating tube can then be removed.

After the leaves are secured by the plates or jigs the old grout, cement or debris is cleaned out by water pressure or water pressure and pressurized air. Excess old grout may be removed through holes drilled at the bottom y either vacuuming or being flushed by water. Thereafter the void or space between the leaves is pre-dampened by water mist or steam and the void is then filled with the appropriate grout or cement, securing the leaves together. The jig or face plates can then be removed along with the threaded rods, and the holes are patched showing virtually no visible sign that the anchorage system of this invention has been used to secure the leaves or walls in place.

Although the invention has been described with respect to the various embodiments of this invention and the methods of use thereof the present system provides positive transverse-to-face tension and compression strength as well as in-plane shear strength by tying and cementing the separated voids together, causes little or no vibration or grout-pressure damage during installation, it should be realized this invention is also capable of a wide variety of further and other embodiments within the spirit and scope of the appended claims.

Figure 11:
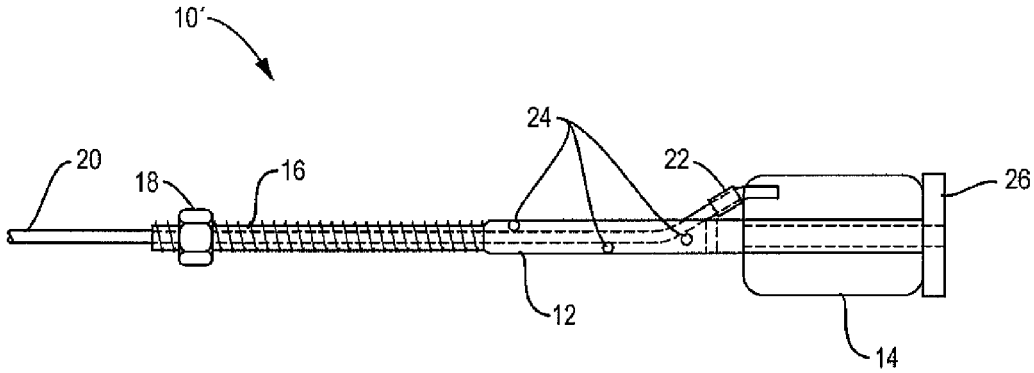
FIGS. 11-16 are side views, schematic representations of further embodiments.

For example, FIG. 11 depicts a similar embodiment to the embodiment shown in FIG. 1 but utilizes a threaded hollow rod 16 at the end of rod 12 instead of the washer and a flat plate 17 having a pair of threaded rods 18 secured thereto. In addition, a breakaway fitting 22 is incorporated therein that permits the feeder pipe 20 to be pulled from the adhesion anchor 14 after filling rather than cutting the feed pipe(s). The breakaway fitting may be made of a rubber tube, but is not limited thereto.

Figure 12:
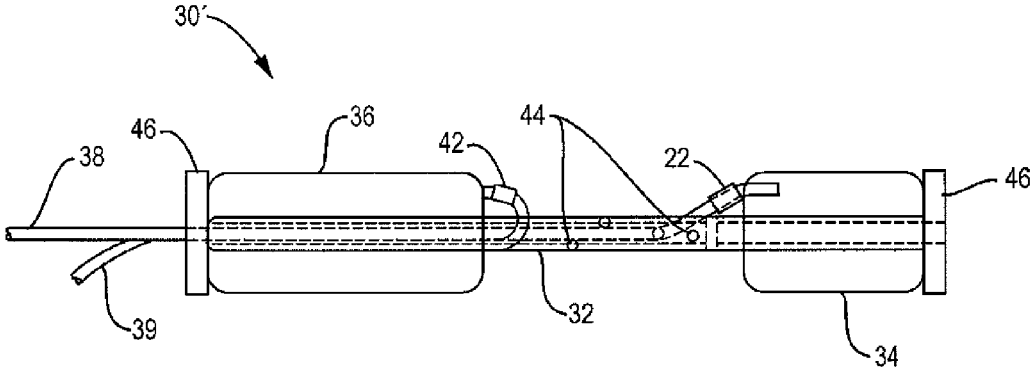
Figure 13:
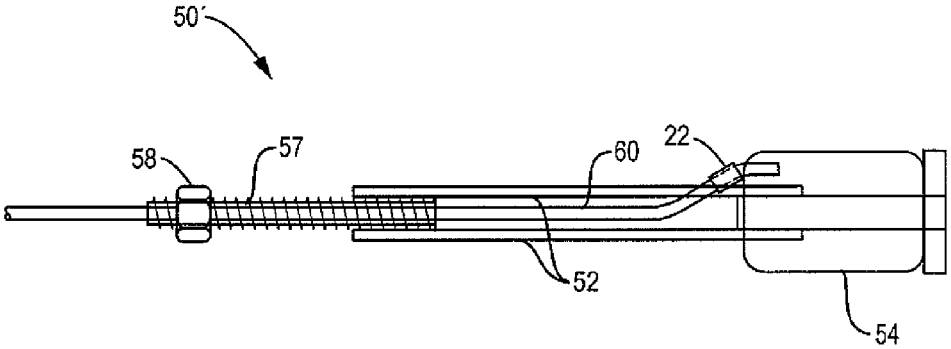
Figure 14:
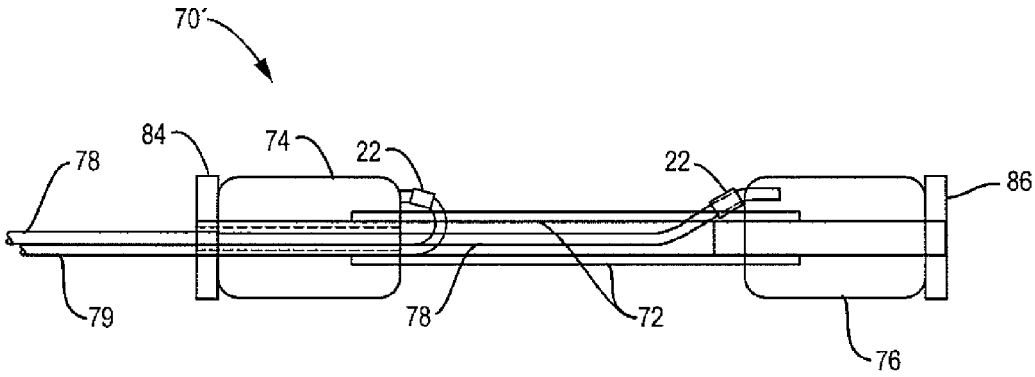
Figure 15:
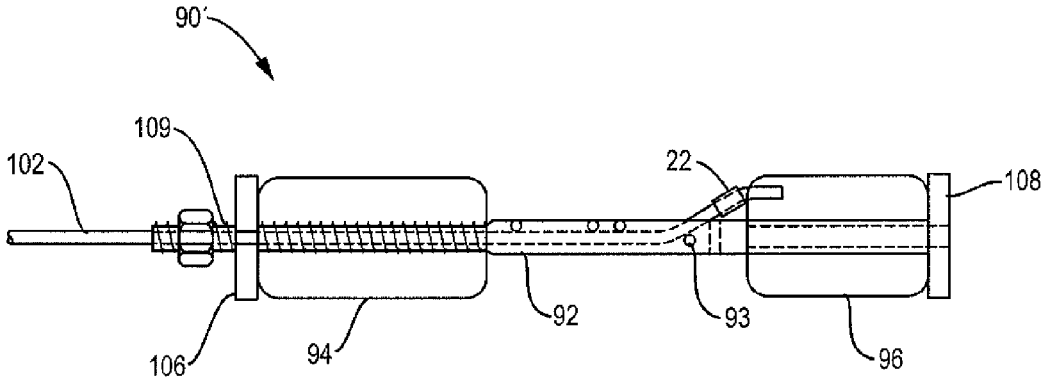
Figure 16:
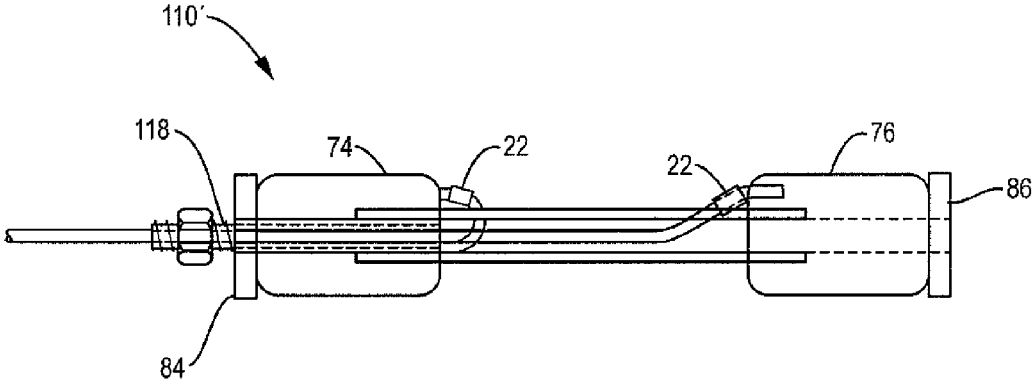

FIG. 12 depicts a similar embodiment to the embodiment shown in FIG. 2 but utilizes breakaway fittings of the type described above. FIG. 13 depicts a similar embodiment to the embodiment shown in FIG. 3 but utilizes the threaded hollow rod 57 and breakaway fitting of the type shown in FIG. 11. FIG. 14 depicts a similar embodiment to the embodiment shown in FIG. 4 but also uses the breakaway fittings described above. FIGS. 15 and 16 depicts similar embodiments to the embodiments shown in FIGS. 5 and 6, respectively, but utilize the threaded hollow rod and breakaway fittings described above.

I claim:

1. An anchor system for use with leaves, layers or other elements of a masonry structure having a void between the leaves, layers or other elements, comprising:

a hollow tube extending in the longitudinal direction of the anchor system, said hollow tube having at least one opening therein extending from an interior of said hollow tube into the void;

a hole located substantially adjacent an end of said hollow tube, said hole permitting a flowable substance to flow into said hollow tube and out of said at least one opening in said hollow tube into the void between adjacent leaves, layers or other elements of the structure;

a hollow adhesion anchor adjacent an end of said hollow tube, said hollow adhesion anchor being made of a flexible material configured to have a hollow interior for receiving a flowable substance therein; and an anchor adjacent another end of said hollow tube; and a feeder tube, being separate and distinct from said hole at the end of said hollow tube, associated with said hollow adhesion anchor for feeding a flowable substance into said hollow interior of said adhesion anchor in order to expand said adhesion anchor.

2. An anchor system as defined in claim 1 wherein said anchor adjacent another end of said hollow tube is another adhesion anchor, said another adhesion anchor being made of a flexible material configured to have a hollow interior for receiving a flowable substance therein.

3. An anchor system as defined in claim 1 wherein said anchor adjacent another end of said hollow tube is a face washer or plate, said face plate having removable threaded rods extending therefrom.

4. An anchor system as defined in claim 2 further comprising a face washer or plate, said face being affixed to another end of said hollow tube and adjacent said another adhesion anchor.

5. An anchor system as defined in claim 1 wherein said anchor adjacent another end of said hollow tube is a face plate, said face plate having removable threaded rods extending therefrom.

6. An anchor system as defined in claim 1 wherein the flowable substance for the hollow adhesion anchor comprises a hardening adhesive substance.

7. An anchor system as defined in claim 2 wherein the flowable substance for the hollow adhesion anchor comprises a hardening adhesive substance.

8. An anchor system as defined in claim 3 wherein the flowable substance for the hollow adhesion anchor comprises a hardening adhesive substance.

9. An anchor system as defined in claim 4 wherein the flowable substance for the hollow adhesion anchor comprises a hardening adhesive substance.

10. An anchor system as defined in claim 5 wherein the flowable substance for the hollow adhesion anchor comprises a hardening adhesive substance.

11. An anchor system as defined in claim 1 wherein the flowable substance for flowing into the void comprises either a liquid under pressure or a hardening substance.

12. An anchor system as defined in claim 2 wherein the flowable substance for flowing into the void comprises either a liquid under pressure or a hardening substance.

13. An anchor system as defined in claim 3 wherein the flowable substance for flowing into the void comprises either a liquid under pressure or a hardening substance.

14. An anchor system as defined in claim 4 wherein the flowable substance for filling the void comprises either a liquid under pressure or a hardening substance.

15. An anchor system as defined in claim 5 wherein the flowable substance for filling the void comprises either a liquid under pressure or a hardening substance.

16. An anchor system as defined in claim 1 wherein said at least one opening comprises more than one opening.

17. An anchor system for use with leaves, layers or other elements of a masonry structure having a void between leaves, layers or other elements, comprising:

at least one rod extending in the longitudinal direction;

a hole located substantially adjacent one end of said at least one rod, said hole permitting a flowable substance to flow adjacent said at least one rod into said void;

a hollow adhesion anchor adjacent one end of said at least one rod, said hollow adhesion anchor being made of a flexible material configured to have a hollow interior for receiving a flowable substance therein;

an anchor adjacent another end of said at least one rod;

a feeder tube, being separate and distinct from said hole at the end of said hollow tube, associated with said hollow adhesion anchor for feeding a flowable substance into said hollow interior of said adhesion anchor in order to expand said hollow adhesion anchor; and an opening adjacent said at least one rod and between said hollow adhesion anchor and said another anchor, said hole permitting a flowable substance to flow adjacent said at least one rod into the void between adjacent leaves, layers or other elements of the structure.

18. An anchor system as defined in claim 17 further comprising a pair of spaced apart rods allowing flow of a flowable substance therebetween into the void.

19. An anchor system as defined in claim 18 wherein said anchor adjacent another end of said at least one rod is another adhesion anchor, said another adhesion anchor being made of a flexible material configured to have a hollow interior for receiving a flowable substance therein.

20. An anchor system as defined in claim 17 wherein the flowable substance for the hollow adhesion anchor comprises a hardening adhesive substance.

21. An anchor system as defined in claim 18 wherein the flowable substance for the hollow adhesion anchor comprises a hardening adhesive substance.

22. An anchor system as defined in claim 19 wherein the flowable substance for the hollow adhesion anchor comprises a hardening adhesive substance.

23. An anchor system as defined in claim 17 wherein the flowable substance for filling the void comprises either a liquid under pressure or a hardening substance.

24. An anchor system as defined in claim 18 wherein the flowable substance for filling the void comprises either a liquid under pressure or a hardening substance.

25. An anchor system as defined in claim 19 wherein the flowable substance for filling the void comprises either a liquid under pressure or a hardening substance.

26. An anchor system as defined in claim 17 wherein said at least one rod comprises more than one rod.

* * * * *